US008636083B2

(12) United States Patent
Nyström

(10) Patent No.: US 8,636,083 B2
(45) Date of Patent: Jan. 28, 2014

(54) ROCK DRILLING DEVICE

(75) Inventor: Sven-Olov Nyström, Örebro (SE)

(73) Assignee: Atlas Copco Rock Drills AB, Orebro (SE)

( * ) Notice: Subject to any disclaimer, the term of this patent is extended or adjusted under 35 U.S.C. 154(b) by 404 days.

(21) Appl. No.: 12/736,650

(22) PCT Filed: May 11, 2009

(86) PCT No.: PCT/SE2009/000242

§ 371 (c)(1),
(2), (4) Date: Oct. 26, 2010

(87) PCT Pub. No.: WO2009/136843

PCT Pub. Date: Nov. 12, 2009

(65) Prior Publication Data

US 2011/0036634 A1 Feb. 17, 2011

(30) Foreign Application Priority Data

May 9, 2008 (SE) ..... 0801050

(51) Int. Cl.
*E21B 7/02* (2006.01)
*E21D 20/00* (2006.01)

(52) U.S. Cl.
USPC ..... 173/184; 173/28; 173/44; 173/152; 173/193

(58) Field of Classification Search
USPC ..... 173/4, 28, 184, 42, 44, 39, 193, 152, 173/185, 190
See application file for complete search history.

(56) References Cited

U.S. PATENT DOCUMENTS

| | | | | |
|---|---|---|---|---|
| 2,698,735 | A * | 1/1955 | Lehner | 173/38 |
| 3,729,056 | A | 4/1973 | Paurat | |
| 3,797,587 | A | 3/1974 | Klein | |
| 3,951,216 | A * | 4/1976 | Crawshay et al. | 173/32 |
| 3,999,805 | A | 12/1976 | Lockwood | |
| 4,069,877 | A | 1/1978 | Durand | |
| 4,199,193 | A * | 4/1980 | Damron et al. | 299/31 |
| 4,251,046 | A | 2/1981 | Walmsley et al. | |
| 4,284,368 | A * | 8/1981 | Albright | 405/291 |
| 4,290,490 | A * | 9/1981 | Barthe et al. | 173/189 |
| 4,346,766 | A * | 8/1982 | Manten | 173/189 |

(Continued)

FOREIGN PATENT DOCUMENTS

| | | |
|---|---|---|
| EP | 0 140 873 | 5/1985 |
| GB | 1482093 | 8/1977 |

(Continued)

*Primary Examiner* — Scott A. Smith
(74) *Attorney, Agent, or Firm* — Mark P. Stone

(57) ABSTRACT

A feeder holding device used with a rock drilling and/or rock bolting rig, in which the rock drilling and/or rock bolting rig has at least one boom with a first end and a second end, the first end is attached to a carrier, and the second end supports a feed beam by the feeder holding device, and in which the feed beam can be adjusted by the feeder holding device in a first drilling position in a first drilling direction and in a second position. The feeder holding device provides linear movement of the feed beam, in a direction different from the drilling direction, from the first drilling position to the second position, such that the feed beam in the second position is pointed in a direction parallel to the first drilling direction. A rock drilling and/or rock bolting rig is also provided.

20 Claims, 3 Drawing Sheets

(56) References Cited

U.S. PATENT DOCUMENTS

| | | | | |
|---|---|---|---|---|
| 4,398,850 | A * | 8/1983 | Talvensaari | 405/259.6 |
| 4,456,077 | A | 6/1984 | Lagerstedt et al. | |
| 4,640,369 | A | 2/1987 | Goyarts | |
| 4,915,180 | A * | 4/1990 | Schisler | 173/185 |
| 5,913,573 | A | 6/1999 | Schlegl et al. | |
| 6,082,469 | A * | 7/2000 | Kromray, Jr. | 173/184 |
| 6,105,684 | A | 8/2000 | Pointer et al. | |
| 6,481,507 | B1 * | 11/2002 | Kromray, Jr. | 173/184 |
| 6,497,536 | B1 * | 12/2002 | Neilson et al. | 405/288 |
| 6,550,544 | B1 | 4/2003 | Saf | |
| 6,602,026 | B1 * | 8/2003 | Neilson | 405/259.1 |
| 6,672,410 | B2 | 1/2004 | Smith | |
| 6,814,155 | B1 | 11/2004 | Nielson et al. | |
| 7,032,686 | B2 | 4/2006 | Barthomeuf et al. | |
| 2005/0103509 | A1 | 5/2005 | Barthomeuf et al. | |
| 2005/0129466 | A1 | 6/2005 | Walker et al. | |

FOREIGN PATENT DOCUMENTS

| | | |
|---|---|---|
| GB | 1498585 | 1/1978 |
| JP | 2005240517 | 8/2005 |
| SU | 607032 | 5/1978 |
| SU | 1097788 | 6/1984 |
| SU | 1567765 | 5/1990 |
| WO | WO 02/103162 | 12/2002 |
| WO | WO 2006/133190 | 12/2006 |

* cited by examiner

ROCK DRILLING DEVICE

FIELD OF THE INVENTION

The present invention pertains to a feeder holding device to be used in drilling and/or bolting. In particular, the present invention pertains to a feeder holding device and to a rock drilling and/or rock bolting rig as disclosed herein.

BACKGROUND OF THE INVENTION

In rock drilling and rock bolting, one often uses a rock drilling rig where one or more drilling machines are carried by respective movable arms, or booms. The booms are usually flexibly attached to a carrier, such as a vehicle, via one or more joints. Furthermore, the drilling machine is usually flexibly attached to the end of the boom away from the carrier via one or more additional joints.

The drilling machine is usually not attached directly to the boom, instead being normally attached to the boom displaceable by a feed unit, for example, consisting of a feeder holder, which carries a feed beam arranged movably relative to the feeder holder, and furthermore the drilling machine is usually movable relative to the feed beam to achieve great freedom of adjustment during drilling thanks to the telescopic action, without the carrier having to move around.

Depending on the type of drilling, such as tunnelling or ore mining, different types of rock drilling rigs are used. For example, when driving a tunnel, one often uses large machines with a plurality of booms, so as to drill a plurality of holes at the same time, or nearly so, while in ore mining, for example, it is often desirable for economic reasons to mine the ore in such a way that only the ore body is mined, thereby reducing as much as possible the amount of excess rock that needs to be handled.

Whether it involves tunnelling or ore mining, it is often necessary to reinforce the rock surfaces exposed by blasting in order to lessen the risk of a cave-in. This reinforcing is often done by first boring a hole and then placing a rock reinforcement bolt in the hole.

This rock reinforcement is usually done by a combined rock drilling and bolting rig, where the same rig first drills the hole and then installs the bolt. In some applications, the very same rig can be used both to drill the blast holes needed for the ore mining/tunnel driving and for subsequent rock reinforcement by installing bolts.

In certain fields of application, such as mining of narrow ore bodies, mining can take place with very low and/or narrow galleries, which places special demands on the rock drilling rig. For example, not only does the desired function need to be assured, but also the existing design constraints must be fulfilled. Rock bolting is often done with bolts over 1 meter in length, and when a rock drilling rig is used for bolting in low/narrow galleries it can be hard to produce a feed unit that enables bolting with the required bolt length without needing complex adjustments of the supporting unit and/or feed unit.

U.S. Pat. No. 7,032,686 B2 shows a rock drilling and bolting rig designed to be used in mines with low gallery height. The rig shown can be used to drill a bolt hole and then install a rock bolt in the borehole. The drilling machine and bolt holder are arranged along a common circular periphery, and when switching between drilling and bolting the layout rotates about the axis of the circle.

Still, there is a need for an improved rock drilling rig to be used in both drilling and bolting, especially for rock drilling rigs designed for very narrow galleries.

SUMMARY OF THE INVENTION

One purpose of the present invention is to provide a feeder holding device which solves the above problem. This purpose is accomplished with a feeder holding device as disclosed herein.

The present invention pertains to a feeder holding device to be used with a mining and/or construction machine, such as a rock drilling and/or rock bolting rig, wherein said rock drilling and/or rock bolting rig comprises at least one boom with a first end and a second end, while said first end is attached to a carrier, and said second end is designed to support a feed beam by means of said feeder holding device, wherein said feed beam can be adjusted by means of said feeder holding device in a first drilling position in a first drilling direction and in a second position.

The feeder holding device is designed for linear movement of said feed beam from said first drilling position to said second position, while the feed beam in said second position is pointed in a direction parallel to said first drilling direction.

The present invention has the advantage that switching between drilling and subsequent bolting can occur easily because the feed beam is moved linearly in a direction separate from the drilling direction. Because the movement is linear, one can easily make sure that the feed beam is pointed parallel to the drilling direction even after the movement, and so the feed beam can be used, e.g., to install a rock bolt.

The feeder holding device can comprise a movement device to bring about said linear movement.

Preferably, a drilling machine is arranged to be movable in relation to said feed beam in the drilling direction, at least during operation.

The invention also pertains to a rock drilling and/or rock bolting rig.

DETAILED DESCRIPTION OF SAMPLE EMBODIMENTS

Figure 1:
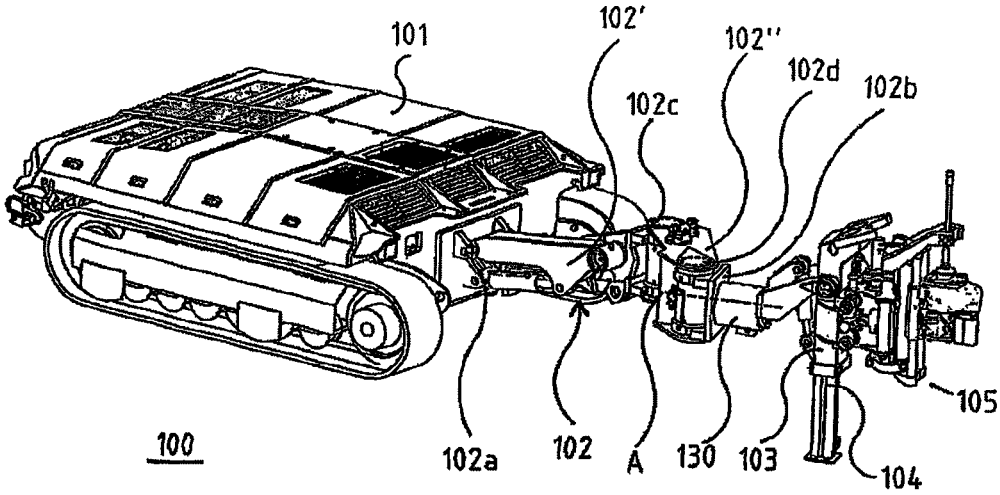
FIG. 1 shows a rock drilling rig designed to be used in drilling and/or rock bolting at low gallery height according to a sample embodiment of the present invention.

FIG. 1 shows a mining machine of the present invention in the form of a rock drilling rig 100, which is especially suitable to be used in drilling and/or bolting when working in very low galleries. For example, there are galleries with a height on the order of 1.2 m, where bolting has to be done with bolt lengths of 1.6 m, for example, to reduce the risk of a cave in.

The rock drilling rig 100 shown consists of a carrier 101 and a boom 102, whose one end 102*a* is fastened to the carrier. The boom 102 consists of two sections 102', 102", joined by a rotational linking means 102*c* to afford great freedom of adjustment during drilling, while at the same time the outer boom section 102" can retract to facilitate moving around (e.g., by reducing the risk of hitting the surrounding rock). At the end 102*b* of the boom 102 away from the carrier 101, a drilling support 103 with support leg 104 is arranged. To the drilling support 103 is fastened a feed unit 105 comprising a feeder holding device according to the present invention, which carries a feed beam. The drilling support is attached to the boom via a rotational linking means 102*d* and a rotational linking means 130. The rotational linking means 102*d* further increases the freedom of adjustment during drilling, and also facilitates positioning of the feed unit 105 during movement. The rotational linking means 130 allows drilling not only in an upward direction, as shown, but in any radial direction looking from the axis A of the rotational link.

A carrier 101 of the type in FIG. 1 is usually controlled not by an operator on board the carrier (due to the relatively small size of the carrier), but instead the rock drilling rig 100 can be controlled remotely by an operator at a suitable control unit, which can be connected to the drilling rig by a cable, for example, or a wireless interface.

The carrier 101 is provided as usual with functions required by the rock drilling rig, such as control units and hydraulic pumps to drive among other things the boom/drilling support/feed unit/drilling machine. The carrier can also have means to operate said hydraulic pump(s), such as an internal combustion engine and/or electric motor, which for example can be operated by connection to appropriate electrical mains.

Figure 2:
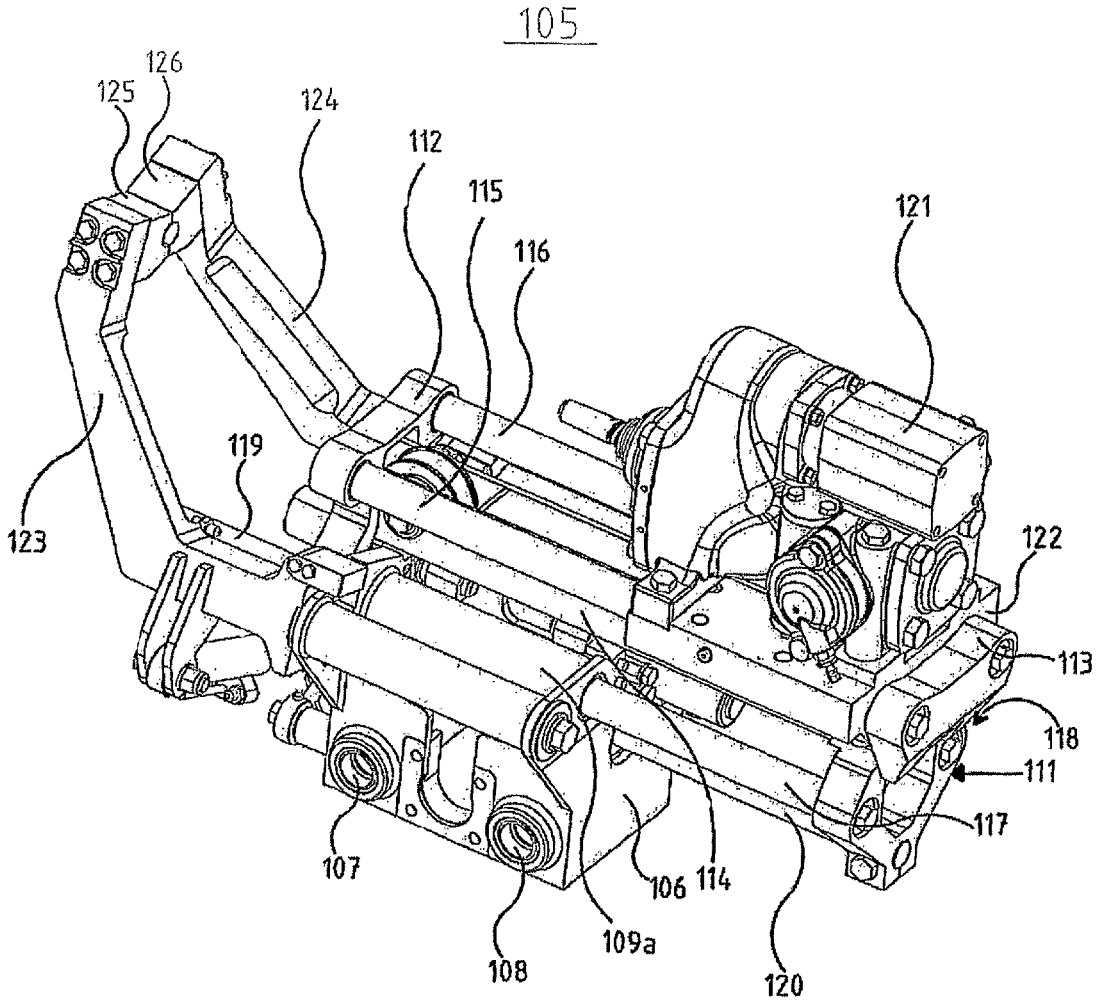
FIG. 2 shows the feed unit of FIG. 1 in more detail.

FIG. 2 shows the feed unit with feeder holding device of the invention in more detail. The feed unit 105 consists of a feeder holding device 106, which in operation is fastened to the drilling support 103 in a way that is specified below and constitutes part of the present invention.

A feed beam, generally designated 111 and consisting of end pieces 112, 113, joined by a web 114 and two guide way pairs 115, 116 and 117, 118, is attached to the feeder holding device.

The feed beam 111 is movably attached to the feeder holding device 106 in that the guide way pair 117, 118 runs in lead-through bushings 109*a* (and the corresponding bushing 109*b* hidden by the feed beam). The feed beam 111 is driven relative to the feeder holding device 106 by a hydraulic cylinder (feed cylinder) 119, whose piston 120 is attached to the end piece 113. The operation of the feed cylinder 119 produces a "stroke length" for the feed beam basically corresponding to the length of the available part of the guide way 117 in the figure.

Moreover, a drilling machine 121 is movably attached to the feed beam 111 by a support unit running on guide ways 115, 116 in the form of a carriage 122. In operation, this allows a telescopic feeding of a drill string or rock bolt connected to the drilling machine 121, the total feeding length consisting of the above-mentioned feed beam feeding length and basically the available length of guide ways 115, 116 in front of the carriage (of course, for design factors, the movement of the feed beam 111 relative to the feeder holding device 106 or the movement of the carriage 122 relative to the feed beam 111 will be limited so that the entire theoretical stroke length cannot be utilised).

Besides said telescopic feeding, FIG. 2 also shows a further drilling support consisting of two arms 123, 124, which are not part of the present invention, but which can come together during operation so that the holder device 125, 126 encloses the drill string or rock bolt during drilling/bolting to facilitate control of same.

In customary feed units, separate and independent actively controlled drive mechanisms (such as feed cylinder 119) are used to drive the movement of the feed beam 111 relative to the feeder holding device 106, or to drive the carriage (drilling machine) along the feed beam (e.g., by a second hydraulic cylinder, or a so-called chain feeder, where a chain is driven by a hydraulic gear motor).

As for the feeder holding device shown in FIG. 2, this comprises only one actively controlled drive device (the feed cylinder 119), yet movement of the carriage 122 relative to the feed beam still occurs at the same time as and depending on the feed cylinder's movement of the feed beam relative to the feeder holding device 106. This is accomplished in that the carriage is attached to the feeder holding device via fastening devices such as a chain or a wire. This is described more in the parallel Swedish patent application with the same filing date, entitled "Feed unit", applicant Atlas Copco Rock Drills AB and inventor Sven-Olov Nyström. Therefore, refer to this parallel application for a better understanding of the drive mechanism in the feed unit shown in FIG. 2.

Although the present invention is exemplified by the embodiment shown in FIG. 2, it will be understood that it is not limited to this feed unit, but is also applicable to other types of feed units, such as those where feed beam and carriage are driven independently of each other by separate drive means, and even those without telescopic action (e.g., when a drilling machine can move relative to a feed beam which is not movable relative to a feeder holding device). What is essential to the invention is the manner of linear movement of the feed beam indicated below.

The feed unit shown in FIG. 2 is thus very compact, and hence especially suitable to be used in drilling/bolting in extremely narrow (low) galleries.

Normally, in a usual rock drilling rig, the feed beam is secured (by means of the feeder holding device) to the drilling support by a suitable connection, such as bolts, but in the sample embodiment of the present invention in FIG. 2 the feeder holding device is secured to the drilling support via openings (lead-through bushings) 107, 108, running along guide ways 301, 302 (see FIG. 3), and it can move along the guide ways 301, 302 thanks to a hydraulic cylinder 303 arranged on the feeder holding device.

This allows the drilling machine, after drilling a hole in a first position along a first drilling axis, to move to a second position, displaced in the lateral direction (and possibly also in longitudinal direction) relative to the first position, yet the feed beam (and thus the drilling machine) is still pointing in a direction parallel to the first drilling axis. This has the advantage that the feed unit can be easily used to install rock bolts, as shall be further explained below.

The method of rock reinforcement by installing a rock bolt is normally done as follows. First, a borehole is drilled for subsequent installing of a rock bolt. When the hole has been drilled, a resin cartridge is inserted, and then the bolt is pressed into the hole and rotated by means of the drilling machine until the resin has hardened to the desired extent. Instead of resin, one can use bolts which expand by means of water, for example, thus moulding to the borehole and being anchored in the surrounding rock.

As mentioned, especially when bolting in low galleries, one must use bolt lengths many times longer than the height of the gallery to provide the desired protection against collapsing rock masses. This is achieved by the use of divisible bolts, where a first bolt element is first inserted then one or more additional bolt elements are added until the desired bolt length is achieved. Despite this option of bolt lengthening, however, each respective part can be so long that the space from the drilling machine to the borehole in the maximum retracted position is still not enough for the bolt or bolt element to fit between the hole and the drilling machine so that it can be pushed in by this.

This also means that the drilling machine, after drilling but before inserting the rock bolt, must be moved away before the rock bolt can be inserted, and then be moved back to complete the installation of the bolt. This movement can occur in various ways. The document U.S. Pat. No. 7,032,686 B2 shows a rig with a device where drilling machine and bolt holder lie on a common circular periphery. When a hole has been drilled and a bolt is to be inserted, the device rotates about the axis of the circle, so the bolt holder can be adjusted in position where the drilling axis intersects the periphery of the circle.

But this method can be needlessly complicated.

The present invention provides a layout which in a very easy way provides switching between drilling and inserting of bolts in cases when the distance between borehole and drilling machine is not enough to find room for the bolt.

Accordingly, the feed beam moves in the lateral direction, so that the drilling machine can easily move to a position where it is not in the way of the bolt inserting, thus easily providing a longer clear distance in the outward extension of the borehole, while feed beam and carriage are still pointing in the drilling direction, though displaced laterally relative to the drilling axis, and so can be used to insert the rock bolt as described below.

Figure 3:
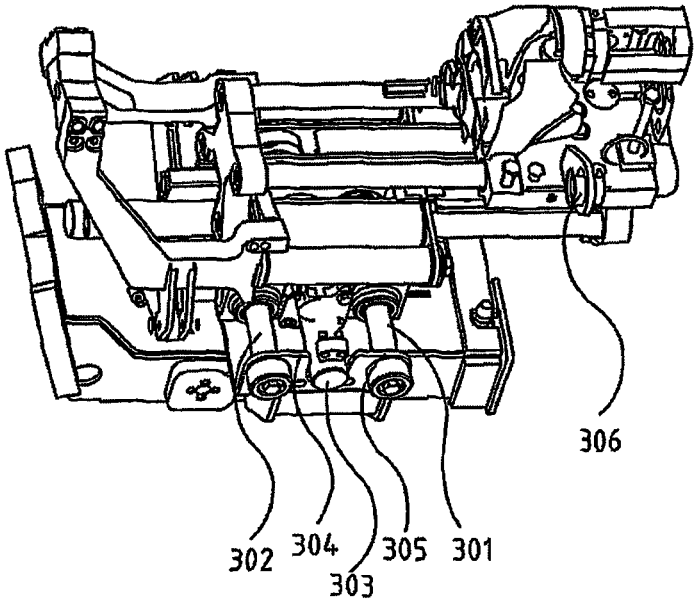
FIG. 3 shows the feed unit of FIG. 2 from a different perspective.

FIG. 3 shows the feed unit of FIG. 2, but from a different perspective, to show the sample embodiment of the invention in more detail. As mentioned, the feed unit (feeder holding device 106) is secured to the drilling support 103 via openings 107, 108, running along guide ways 301, 302, and its movement along the guide ways is controlled by a hydraulic cylinder 303.

During drilling, the feeder holding device is moved along the guide ways 301, 302 such that the feed unit is close to or even abuts against stops 304, 305, i.e., opposite what is shown in the figure, where the feed unit is moved away from the stop 304, 305 during drilling per the above.

On the other hand, when inserting a bolt into a newly drilled hole, the feed unit is moved along the guide ways 304, 305 to the position shown in FIG. 3, so that the drilling machine is moved laterally, and the bolt (or a first bolt section, if the bolt consists of several sections) can be placed against the drilled hole (or added to the preceding bolt element) so as to place the end of the bolt away from the hole against a bolt support 306 arranged on the carriage 122, and then the bolt or bolt element can be pushed into the hole by operation of the feed beam 111 and carriage 122 via the bolt support 306. Accordingly, the feed beam 111 will automatically be properly oriented and thus it can easily be positioned, by operating the cylinder 303, in the position shown in FIG. 3 for pushing in the bolt. Since the bolt support can be arranged substantially at a longer distance from the drilling hole compared to the front edge of the drilling machine, the invention provides by a simple displacement mechanism thus enables bolting with longer lengths than would be possible without any movement of the drilling machine. After the bolt has been pushed into the borehole, the drilling machine is moved back thanks to the displacement mechanism into the drilling position, where the drilling machine can be used for appropriate rotation of the bolt.

In the description above, the movement mechanism of the invention is shown travelling along two guide ways and essentially perpendicular to the drilling direction. However, the movement need not be perpendicular to the drilling direction, as long as the movement results in the drilling machine moving linearly lateral while retaining the orientation (i.e., in parallel to the drilling direction) of the carriage.

Figure 4:
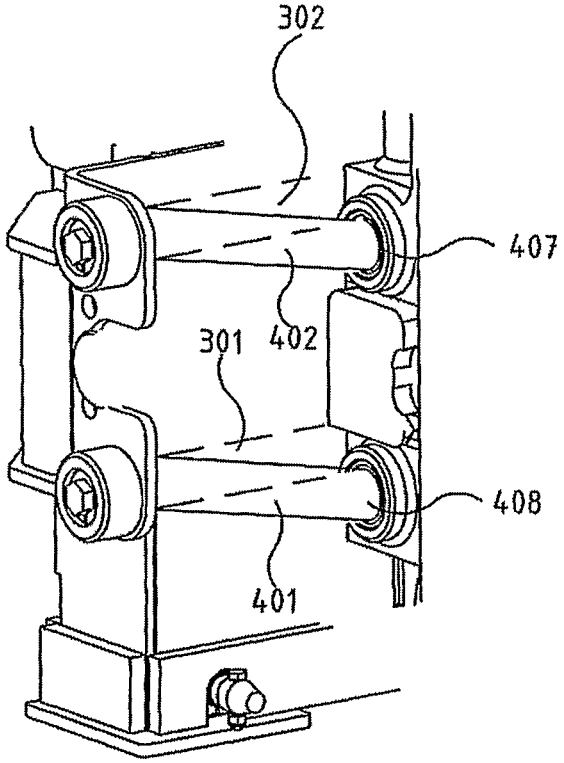
FIG. 4 shows an alternative embodiment of the present invention.

For example, the guide ways 301, 302 can be slanted instead. This is illustrated by FIG. 4, which shows part of the feed unit of FIG. 2, and where the guide ways 301, 302 running perpendicular to the drilling direction are shown schematically by dashed lines. The guides 401, 402 in FIG. 4 instead are bent backward (compared to the drilling direction), and the feeder holding device has correspondingly slanted openings 407, 408 so that the drilling machine during displacement is not only moved laterally in parallel to the side, but also somewhat backward, which can make possible, e.g., additional bolt length (it is even conceivable for the guide ways to slant toward the borehole, if appropriate, so that there will be a forward movement instead).

Moreover, although the invention in the above specification has been illustrated with a certain type of feed unit, the invention is equally applicable to other types of feed units. What is essential to the invention is that a feed beam is moved linearly in relation to a boom (or in relation to a device attached to a boom, such as a drilling support) and in a direction other than the drilling direction in such a way that the feed beam after displacement still is parallel to the position before movement.

Thus, the appearance of the feeder holding device can also differ substantially from the embodiment in the figure, without thereby departing from the invention as defined in the enclosed claims. In theory, the feeder holding device can take on any desired appearance, as long as it provides the movement of the feed beam relative to the boom according to the invention.

For example, it can consist of only one guide way, or of a totally different movement mechanism, as long as linear lateral movement of the feed beam is allowed with maintained orientation.

For example, the openings can be integrated with the feed beam, in which case the feed beam thus is laterally displaceable exactly as described above, with the difference that the feed beam is not movable in the drilling direction relative to the feeder holding device.

Moreover, the guide ways (or corresponding sliding means) can be firmly joined to the feed beam, at which they instead travel in suitable means on the boom (or, as in the embodiment illustrated here, a means attached to the boom, such as a drilling support). Likewise, the movement driving means (hydraulic cylinder 303 above) can be attached to the boom or the drilling support, or the feed beam.

Moreover, the invention above has been described in regard to a specific type of feed beam. As is realized however, the invention can also be used for other types of feed beams, e.g., feed beams with more or fewer guide ways, or feed beams whose carriage slides along sliding surfaces and not necessarily on guide ways.

The invention claimed is:

1. Feeder holding device for a rock drilling or rock bolting rig, wherein said rock drilling or rock bolting rig comprises at least one boom with a first end and a second end, wherein said first end is attachable to a carrier, and said second end is adapted to support a feed beam by means of the feeder holding device, wherein said feed beam is adjustable by means of said feeder holding device between a first drilling position in a first drilling direction and a second position, wherein said feeder holding device provides linear lateral movement of said feed beam, in a second direction different from said first drilling direction, from said first drilling position to said second position, such that the feed beam in said second position is oriented in a direction parallel to said first drilling direction.

2. Feeder holding device according to claim 1, wherein said feeder holding device is adapted to move said feed beam linearly in said second direction at an angle in the range of 15-90 degrees relative to said drilling direction.

3. Feeder holding device according to claim 2, wherein said feeder holding device comprises at least one guide way, and said feed beam is movable linearly in said second direction by means of said at least one guide way.

4. Feeder holding device according to claim 3, wherein said at least one guide way is adapted for movement of the feed beam in at least one lead-through bushing arranged in the feeder holding device.

5. Feeder holding device according to claim 3, wherein said feeder holding device is attachable to a drilling support connected to said boom, said feed beam being movable relative to said drilling support in said second direction.

6. Feeder holding device according to claim 3, wherein said feeder holding device is adapted to move said feed beam relative to said feeder holding device in a direction parallel to the drilling direction.

7. Feeder holding device according to claim 3, further including drive means for moving the feed beam, said drive means including a hydraulic cylinder or a hydraulic motor.

8. Feeder holding device according to claim 2, wherein said feeder holding device is movable along at least one guide way in said second direction, said feed beam being secured to said feeder holding device.

9. Feeder holding device according to claim 2, wherein said feeder holding device is attachable to a drilling support connected to said boom, said feed beam being movable relative to said drilling support in said second direction.

10. Feeder holding device according to claim 2, wherein said feeder holding device is adapted to move said feed beam relative to said feeder holding device in a direction parallel to the drilling direction.

11. Feeder holding device according to claim 2, further including drive means for moving said feed beam, said drive means including a hydraulic cylinder or a hydraulic motor.

12. Feeder holding device according to claim 1, wherein said feeder holding device comprises at least one guide way, and said feed beam is movable linearly in said second direction by means of said at least one guide way.

13. Feeder holding device according to claim 12, wherein said at least one guide way is adapted for movement of said feed beam in at least one lead-through bushing arranged in the feeder holding device.

14. Feeder holding device according to claim 12, wherein said feeder holding device is movable along at least one guide way in said second direction, said feed beam being secured to said feeder holding device.

15. Feeder holding device according to claim 12, wherein said feeder holding device is attachable to a drilling support connected to said boom, said feed beam being movable relative to said drilling support in said second direction.

16. Feeder holding device according to claim 1, wherein said feeder holding device is movable along at least one guide way in said second direction, said feed beam is being secured to said feeder holding device.

17. Feeder holding device according to claim 1, wherein said feeder holding device is attachable to a drilling support connected to said boom, said feed beam being movable relative to said drilling support in said second direction.

18. Feeder holding device according to claim 1, wherein said feeder holding device is adapted to move said feed beam relative to said feeder holding device in a direction parallel to the drilling direction.

19. Feeder holding device according to claim 1, further including drive means for moving said feed beam, said drive means including a hydraulic cylinder or a hydraulic motor.

20. Rock drilling or rock bolting rig, comprising at least one boom with a first end and a second end, wherein said first end is attached to a carrier, and said second end is adapted to support a feed beam, wherein said feed beam is adjustable between a first drilling position in a first drilling direction and a second position, wherein said rock drilling or rock bolting rig further comprises means for linearly and laterally moving said feed beam relative to said boom, in a direction different from said first drilling direction, from said first drilling position to said second position, such that the feed beam in said second position is oriented in a direction parallel to said first drilling direction.

* * * * *